US005874927A

United States Patent [19]

Knowles et al.

[11] Patent Number: 5,874,927

[45] Date of Patent: Feb. 23, 1999

[54] TILTED ELEMENT ANTENNA HAVING INCREASED EFFECTIVE APERTURE AND METHOD THEREFOR

[76] Inventors: Patrick J. Knowles, 1610 Old Bay La., Severn, Md. 21144; Timothy G. Waterman, 303 Quail Dr., Eldersburg, Md. 21784

[21] Appl. No.: 734,144

[22] Filed: Oct. 21, 1996

[51] Int. Cl.[6] ..... H01Q 1/36

[52] U.S. Cl. ..... 343/895; 343/844

[58] Field of Search ..... 343/796, 895, 343/844; 29/600; H01Q 1/36, 21/00

[56] References Cited

U.S. PATENT DOCUMENTS

| | | | |
|---|---|---|---|
| 2,903,694 | 8/1959 | Klancnik, Jr. | 343/805 |
| 2,966,678 | 12/1960 | Harris | 343/895 |
| 4,309,707 | 1/1982 | James et al. | 343/895 |
| 5,041,842 | 8/1991 | Blaese | 343/882 |
| 5,081,468 | 1/1992 | Williams | 343/895 |
| 5,258,771 | 11/1993 | Praba | 343/895 |
| 5,345,248 | 9/1994 | Hwang et al. | 343/895 |
| 5,539,421 | 7/1996 | Hong | 343/895 |

FOREIGN PATENT DOCUMENTS

| | | | |
|---|---|---|---|
| 1008359 | 5/1952 | France | 343/895 |
| 2050701 | 1/1981 | United Kingdom . | |

OTHER PUBLICATIONS

Richard C. Johnson *Antenna Engineering Handbook*, Third Edition, Chapter 13, entitled "Helical Antennas" by Howard E. King and Jimmy L. Wong.

*Primary Examiner*—Don Wong
*Assistant Examiner*—Tan Ho

[57] ABSTRACT

A tilted helical element antenna array has increased effective aperture. By tilting individual helical radiators relative to one another, the region of aperture overlap may be decreased to thereby increase the effective aperture of the array. Helical radiators are disposed at a radiator spacing which is less than the operating wavelength λ. At such a small spacing, the apertures of each of the helical radiators overlap. To decrease this aperture overlap region and thereby increase the effective aperture of the array, each of the helical radiators are tilted relative to one another. Thus, a compact antenna having an increased effective aperture is provided.

13 Claims, 7 Drawing Sheets

TILTED ELEMENT ANTENNA HAVING INCREASED EFFECTIVE APERTURE AND METHOD THEREFOR

BACKGROUND OF THE INVENTION

1. Field of the Invention

The present invention relates to helical antennas, and, more particularly, to an apparatus and method which tilts closely spaced helical radiators in a multiple element array to increase the effective aperture of the antenna.

2. Description of the Related Art

Helical antennas generally consist of a single conductor or multiple conductors (multi-filar) wound into a helical shape. Although such antennas can radiate in many modes, the axial mode is most commonly used. The axial mode generates maximum radiation along the helix axis. By constructing the helix such that the helix's circumference is on the order of one wavelength of the radiation being emitted, the helix will radiate in the axial mode. The radiation emitted from a helical antenna is circularly polarized with the handedness of the polarization determined by the handedness in which the helix is wound.

FIG. 11 graphically depicts the substantially overlapping apertures (700,710) of a first helical radiator 720 and second helical radiator 730. The first and second helical radiators (720,730) have first and second radiation apertures (700, 710), respectively. The first radiation aperture 700 and the second radiation aperture 710 substantially overlap to form an aperture overlap region 740.

The first helical radiator 720 is spaced apart from the second helical radiator 730 by a radiator spacing L. As the radiator spacing L decreases from λ, the aperture overlap region 740 correspondingly increases in size. This increase in the aperture overlap region 740 decreases the effective aperture of the antenna array. The effective aperture is the union of the first radiation aperture 700 and second radiation aperture 710.

FIG. 12 shows a conventional two helical element antenna array having a first helical radiator 820 and second helical radiator 830. The first and second helical radiators (820, 830) have first and second radiation apertures (800, 810).

By spacing the first helical radiator 820 apart from the second helical radiator 830 by a radiator spacing L' that is approximately a wavelength λ, the aperture overlap region 740 (shown in FIG. 11) may be avoided. Thus, the effective aperture of the antenna array shown in FIG. 12 is at a maximum because the aperture overlap region does not occur. Such a large radiator spacing L', however, increases the size of the antenna array. Because compact antenna arrays are advantageous, such an increase in size should be avoided.

When compared with a single helical element antenna, the dual helical element antenna shown in FIG. 12 has an effective aperture and gain which is twice (3 dB) that of the single element helical antenna. As the spacing L' is reduced, the effective aperture of the two helical element antenna quickly approaches the effective aperture of a single helical antenna. When the two helical radiators 820, 830 are spaced apart by approximately one wavelength of the signal to be radiated, however, the size of the antenna increases. Such size increases are undesirable.

SUMMARY OF THE INVENTION

Accordingly, a primary object of the present invention is to provide a multiple helical element antenna having increased effective aperture and decreased size.

It is a further object to provide a method of efficiently radiating a signal from a multiple helical element antenna having compact size.

The objects of the present invention are fulfilled by providing an antenna including a first helical radiator having a first helix axis, a second helical radiator having a second helix axis spaced apart from the first helix axis by a distance substantially equal to half of an operating wavelength of a signal being transmitted or received by the first and second helical radiators, wherein the first helix axis is not parallel to the second helix axis. More particularly, the first helix axis is tilted by an inclination angle with respect to the second helix axis.

Alternatively, the objects of the present invention are fulfilled by providing an antenna including first, second and third helical radiators having first, second and third helix axes, respectively, wherein the second helix axis is spaced apart from the first helix axis by a distance substantially equal to λ/2, wherein the third helix axis is spaced apart from the second helix axis by a distance substantially equal to λ/2 and wherein the first helix axis is not parallel to the second helix axis and further wherein the third helix axis is not parallel to the second helix axis. More particularly, the first helix axis is tilted by a first inclination angle with respect to the second helix axis and the third helix axis is tilted by a second inclination angle with respect to the second helix axis.

The objects of the present invention are further achieved by providing a method of efficiently radiating and receiving a signal of wavelength λ along an antenna including the steps of delivering the signal to a first helical radiator having a first helix axis, delivering the signal to a second helical radiator having a second helix axis, spacing the first helix axis at a distance substantially equal to λ/2 from the second helix axis, and tilting the first helix axis relative to the second helix axis such that the first helix axis is not parallel to the second helix axis.

Alternatively, the objects of the present invention are further achieved by providing a method which includes the steps of delivering a signal of wavelength λ to a first, second and third helical radiators having first, second and third helix axes; spacing the first helix axis at a distance substantially equal to λ/2 from the second helix axis; spacing the third helix axis at a distance substantially equal to λ/2 from the second helix axis; a first tilting step for inclining the first helix axis relative to the second helix axis such that the first helix axis is not parallel to the second helix axis; and a second tilting step for inclining the third helix axis relative to the second helix axis such that the third helix axis is not parallel to the second helix axis.

These and other objects of the present invention will become more readily apparent from detailed description given hereinafter. However, it should be understood that the detailed description and specific examples, while indicating the preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limited to the present invention and wherein.

DETAILED DESCRIPTION OF THE PREFERRED EMBODIMENTS

Figure 1A:
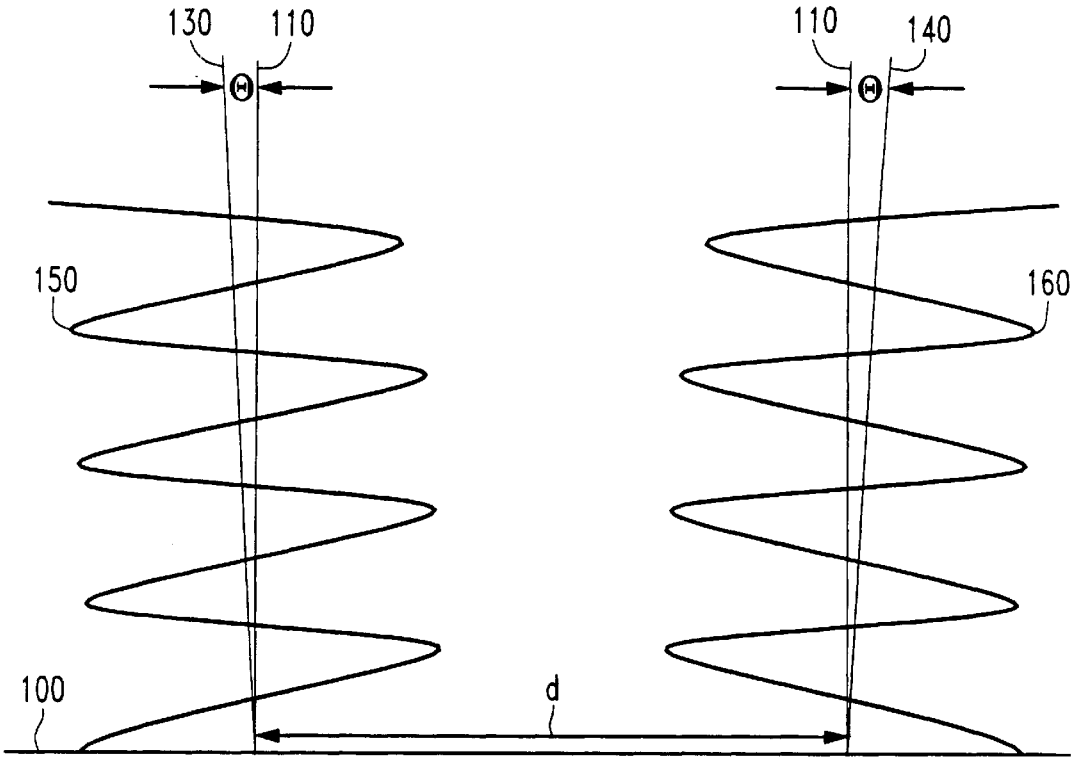
FIGS. 1(*a*) and (*b*) are a side view and perspective view of a two helical element antenna of the present invention, respectively.
Figure 1B:
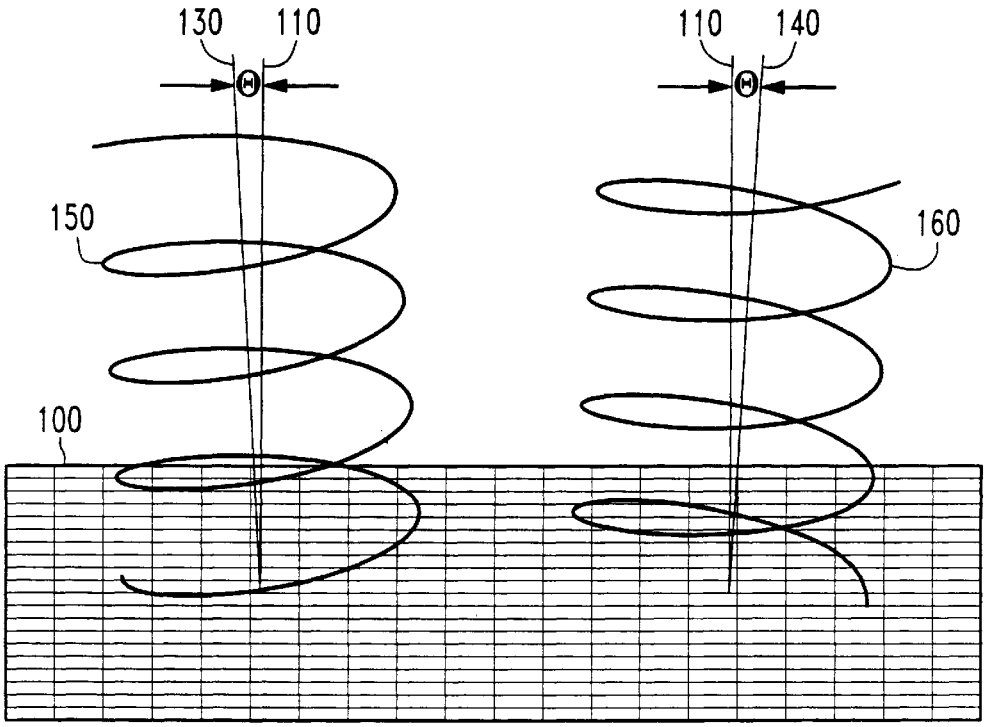

FIGS. 1(*a*) and 1(*b*) illustrate a two helical element antenna with a side view and perspective view, respectively. The first helical radiator 150 has an associated first helix axis 130. A second helical radiator 160 has an associated second helix axis 140. The first helical radiator 150 is spaced apart from the second helical radiator 160 by a distance d.

Reference axis 110 is perpendicular to ground plane 100. The first helix axis 130 of the first helical radiator 150 is inclined by an angle θ relative to a reference axis 110. The second helix axis 140 is inclined by an inclination angle θ relative to the reference axis 110.

When operating in the axial mode, the circumference of the first helical radiator 150 and second helical radiator 160 should be on the order of a wavelength λ of a signal being radiated or received. The number of turns in the helix of the first helical radiator 150 and the second helical radiator 160 is not critical. The same is true for the spacing of the turns and axial length of the helix.

Although the preferred embodiment employs the same inclination angle θ for both the first helical radiator 150 and a second helical radiator 160, it is to be understood that the inclination angle for each helical radiator may be different. Preferably, however, this inclination angle θ is the same for the first helical radiator 150 and a second helical radiator 160. Preferably, the inclination angle θ should be approximately 4°. Stated another way, the first helix axis 130 of the first helical radiator 150 is inclined by approximately 8° with respect to the second helix axis 140 of the second helical radiator 160.

Figure 3:
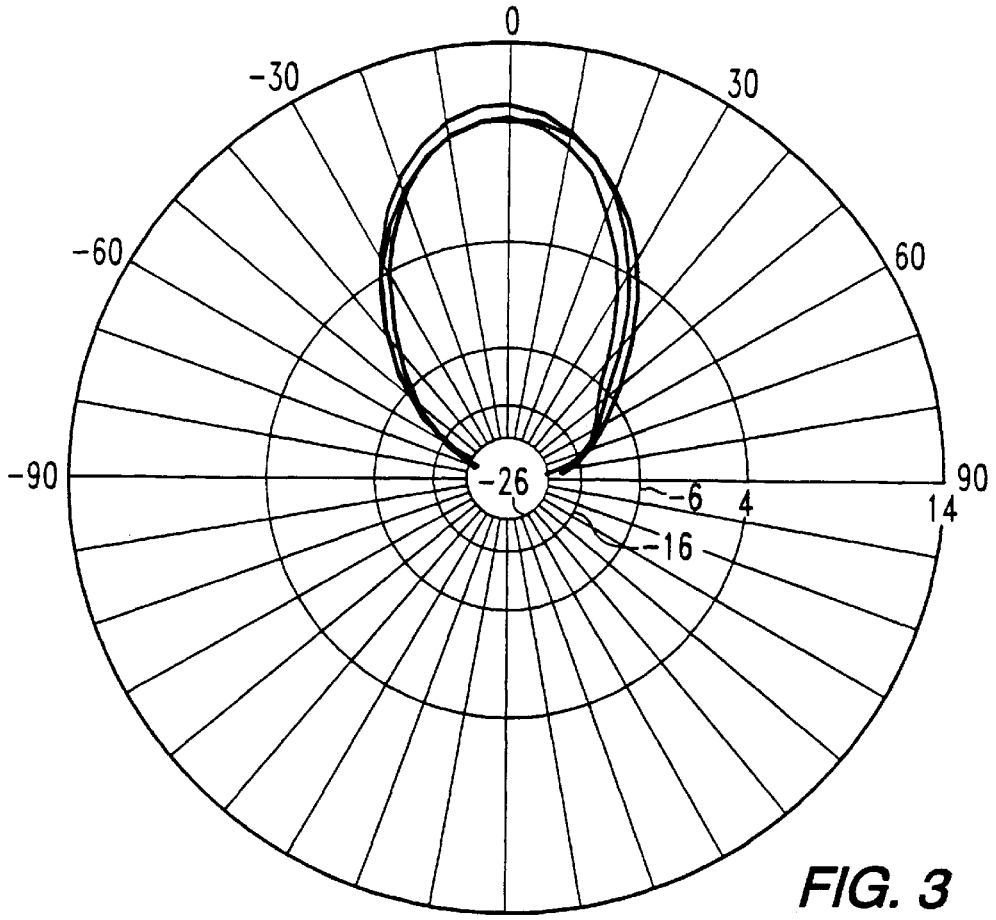
FIG. 3 shows the calculated radiation pattern of a non-tilted helical element antenna.
Figure 4:
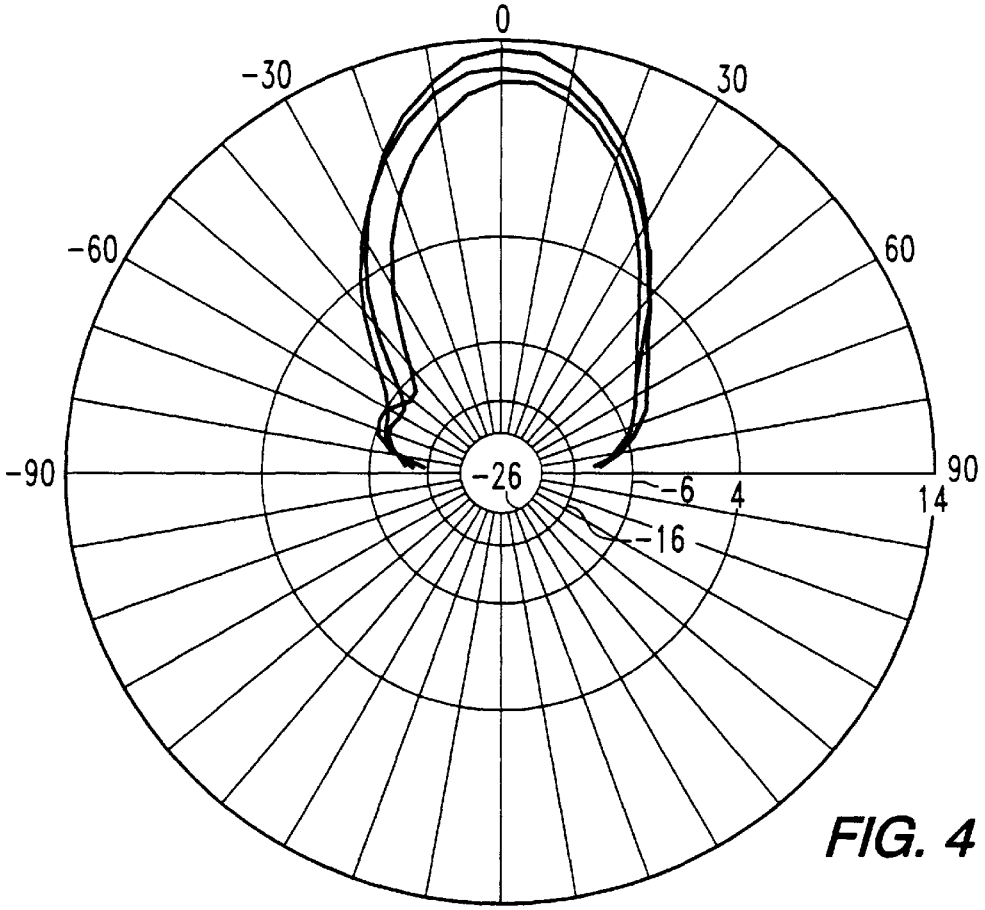
FIG. 4 shows the calculated radiation pattern of a tilted helical element antenna of the present invention.

FIGS. 3 and 4 graphically compare the calculated radiation pattern of a conventional, non-tilted helical element antenna and the calculated radiation pattern of a tilted helical element antenna of the present invention, respectively. Referring to FIGS. 3 and 4, it can be seen that the gain of the tilted helical element antenna of the present invention is greater than the gain of the non-tilted helical element antenna conventionally known.

This increase in gain is explained by the increased effective aperture of the tilted helical element antenna of the present invention. In other words, by tilting the first helical radiator 150 relative to the second helical radiator 160, the apertures of these helical radiators (150, 160) combine to produce an antenna having an increased effective aperture. If the helical radiators were not tilted, then the apertures of each helical radiator would overlap thereby decreasing the overall effective aperture of the antenna array.

The radiator spacing d between the first helical radiator 150 and the second helical radiator 160 should be less than a wavelength. A radiator spacing d greater than a wavelength would not enjoy the benefits of compact antenna design that this invention is intended to fulfill. Preferably, the radiator spacing d should be approximately λ/2. By tilting the first helical radiator 150 relative to the second helical radiator 160 and using a radiator spacing d that is substantially equal to λ/2, the effective aperture of the antenna array may be increased while retaining compact antenna design.

Figure 2:
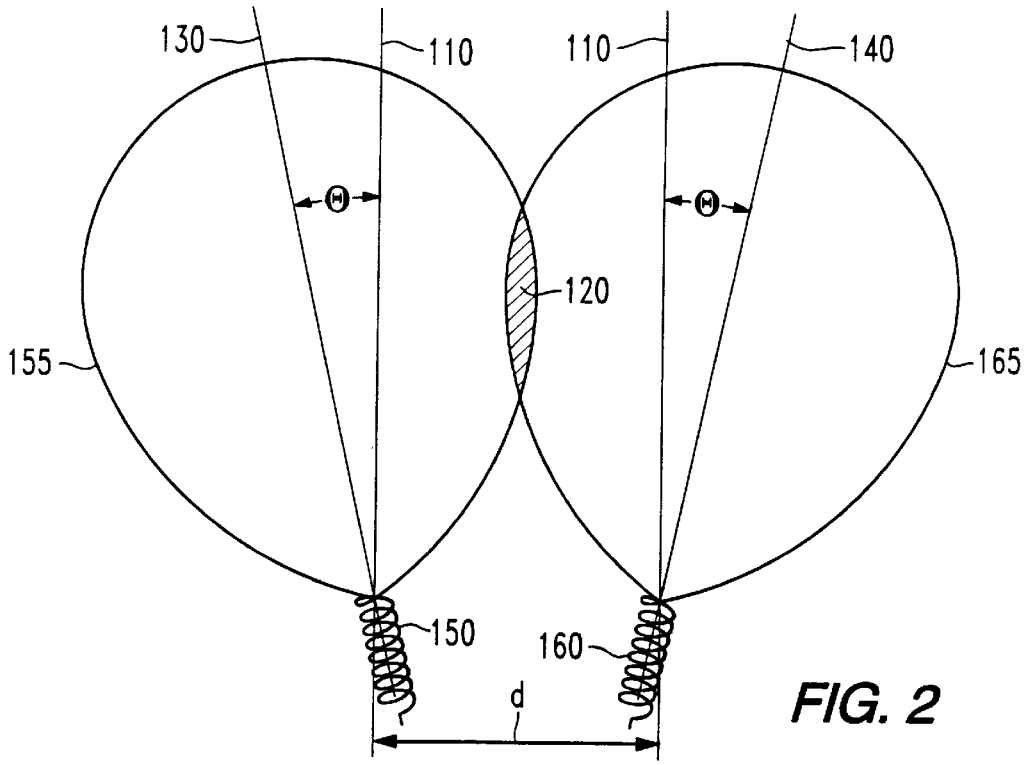
FIG. 2 is a plan view of a two helical element antenna of the present invention.

FIG. 2 shows the operation of the tilted helical element antenna of the present invention. The first helical radiator 150 radiates a beam having a first radiation aperture 155. The second helical radiator 160 radiates a beam having a second radiation aperture 165. By tilting the first helical radiator 150 and the second helical radiator by an inclination angle θ relative to a reference axis 110, the aperture overlap region 120 is reduced. By reducing the aperture overlap region 120, the effective aperture of the antenna array is increased. The effective aperture is the union of the first radiation aperture 155 and a second radiation aperture 165.

Figure 5:
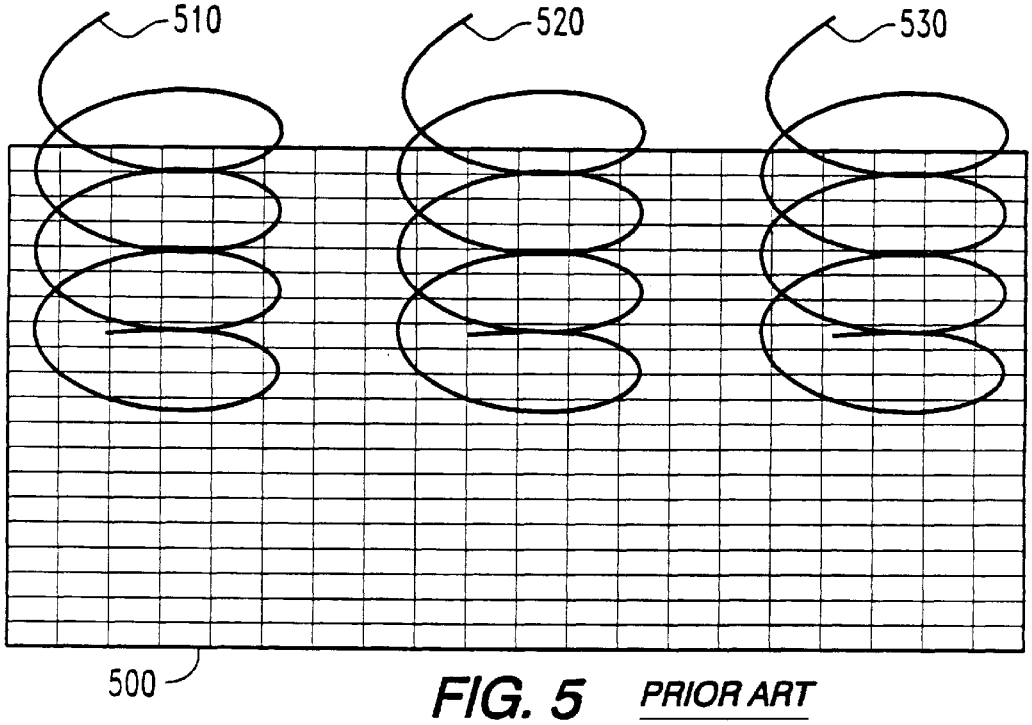
FIG. 5 PRIOR ART
FIG. 5 is a perspective view of a non-tilted three helical element antenna.

FIG. 5 depicts a conventional antenna array having three helical elements. This antenna array includes a first helical radiator 510, second helical radiator 520 and third helical radiator 530. These helical radiators (510, 520, 530) are mutually parallel. Ground plane 500 is further provided for the three element antenna array. FIG. 5 is presented for the purpose of illustrating the difference between a conventional antenna array and the present invention.

Figure 6:
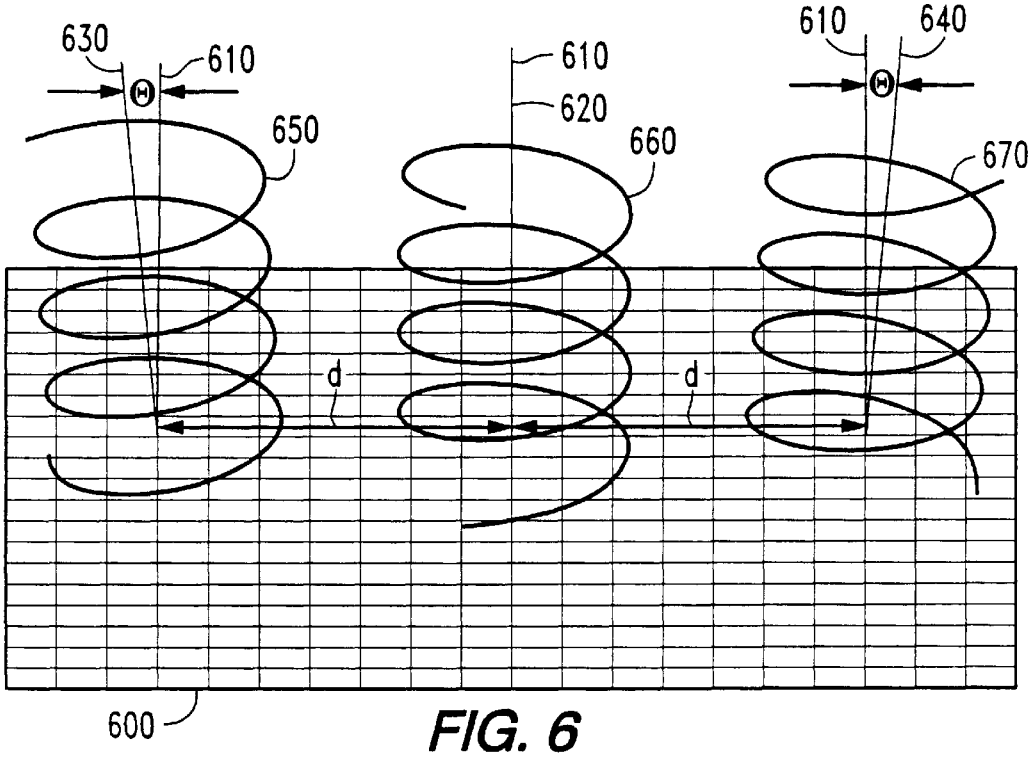
FIG. 6 is a perspective view of a tilted three helical element antenna of the present invention.

FIG. 6 is a perspective view of a second preferred embodiment of the present invention. According to FIG. 6, three reference axes 610 are perpendicular to a ground plane 600. This embodiment employs a first helical radiator 650, a second helical radiator 660 and a third helical radiator 670 having associated first helix axis 630, second helix axis 620 and third helix axis 640, respectively. The first helix axis 630 is tilted by an inclination angle θ relative to the reference axis 610. The third helix axis 640 is tilted by an inclination angle θ relative to the reference axis 610. The second helix axis 620 is parallel to the reference axis 610. Thus, the first helix axis 630 and the third helix axis 640 are tilted relative to the second helix axis 620.

The first helical radiator 650 is disposed at a radiator spacing d apart from the second helical radiator 660. The third helical radiator 670 is also disposed at a radiator spacing d apart from the second helical radiator 660. Although FIG. 6 shows the first, second and third helical radiators disposed in a linear relation, it is to be understood that this invention is not limited to this linear relationship and may include disposing each radiator at respective corners of a triangle. To emit a symmetrical beam, this triangle should preferably be an isosceles triangle.

As discussed in detail above in regards to the two helical element antenna array, the three helical element antenna array enjoys the same benefits of increase effective aperture and compact antenna design. By disposing the first, second and third helical radiators at a distance d which is less than an operating wavelength λ and by inclining the helical radiators relative to one another, an increased effective aperture and compact antenna design may be achieved.

Figure 7:
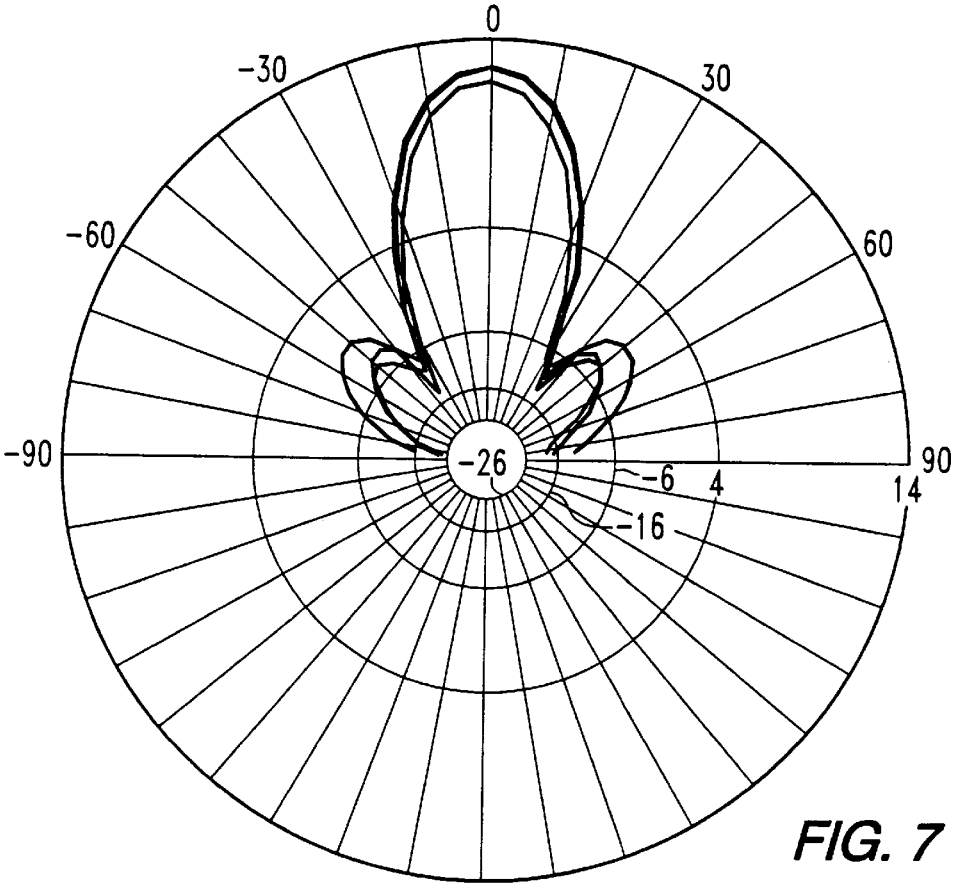
FIG. 7 shows the calculated radiation pattern of a non-tilted three helical element antenna array.
Figure 8:
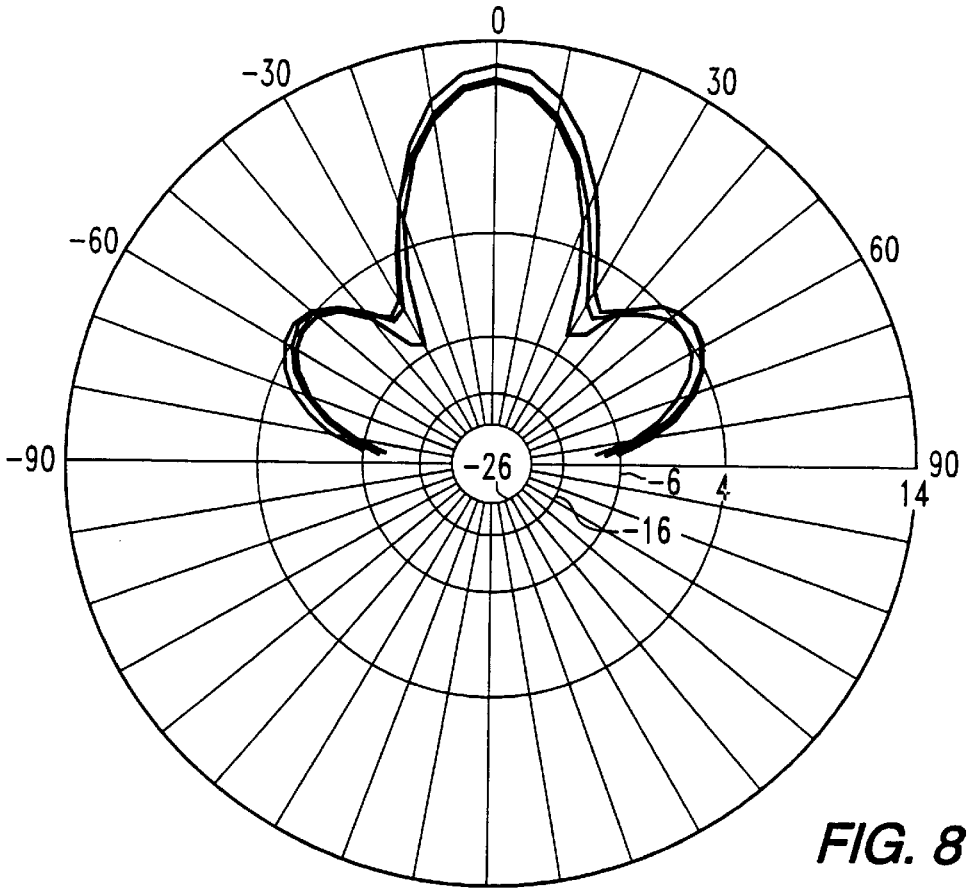
FIG. 8 shows the calculated radiation pattern of a tilted three helical element array of the present invention.
Figure 11:
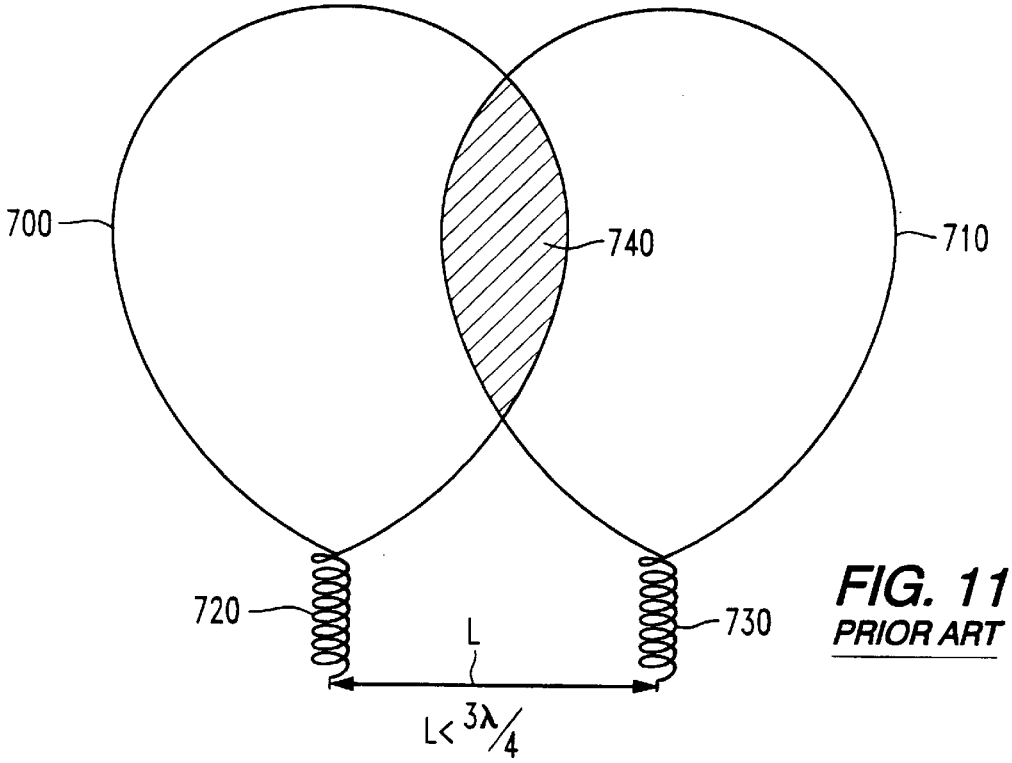
FIG. 11 PRIOR ART
FIG. 11 is a plan view of a non-tilted two helical element antenna array of the background art.

FIGS. 7 and 8 compare the calculated gain of a conventional three helical element array having no relative tilt for the helical radiators with the calculated gain of a three helical element array having relative tilt.

More particularly, FIG. 7 depicts the gain of a 0° tilt conventional system and FIG. 8 shows the gain of a three helical element array wherein the inclination angle θ for the first helical radiator 650 and the second helical radiator 670 is 4°. As can be seen from FIGS. 7 and 8, the gain of the present invention is higher than the gain of the conventional non-tilted three helical element array.

Figure 9:
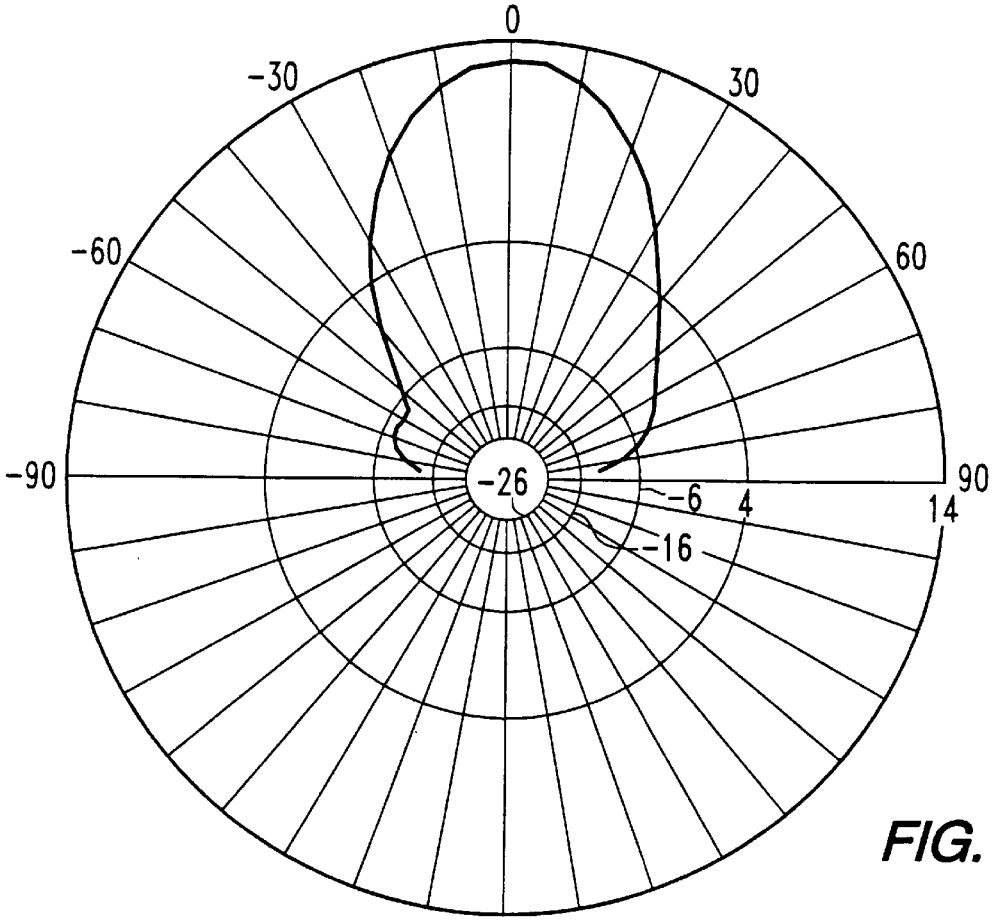
FIG. 9 shows the calculated radiation pattern of a tilted two helical element antenna array.
Figure 12:
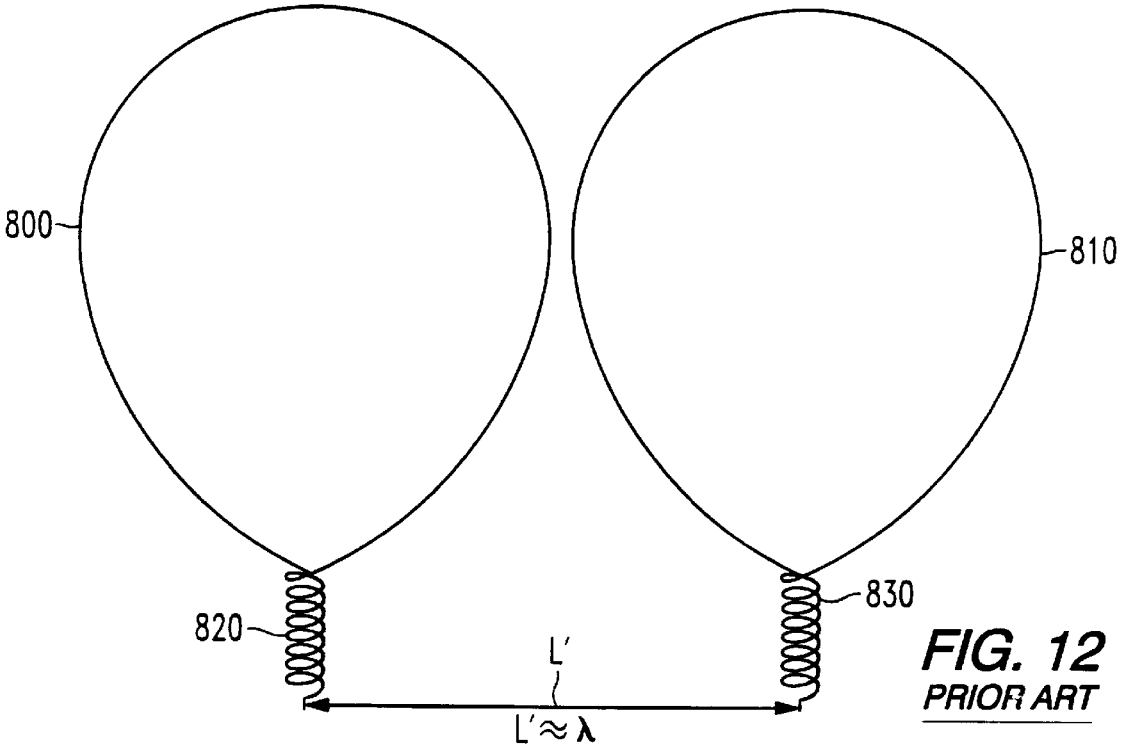
FIG. 12 PRIOR ART
FIG. 12 is a plan view of a non-tilted two helical element antenna array of the background art.
Figure 10:
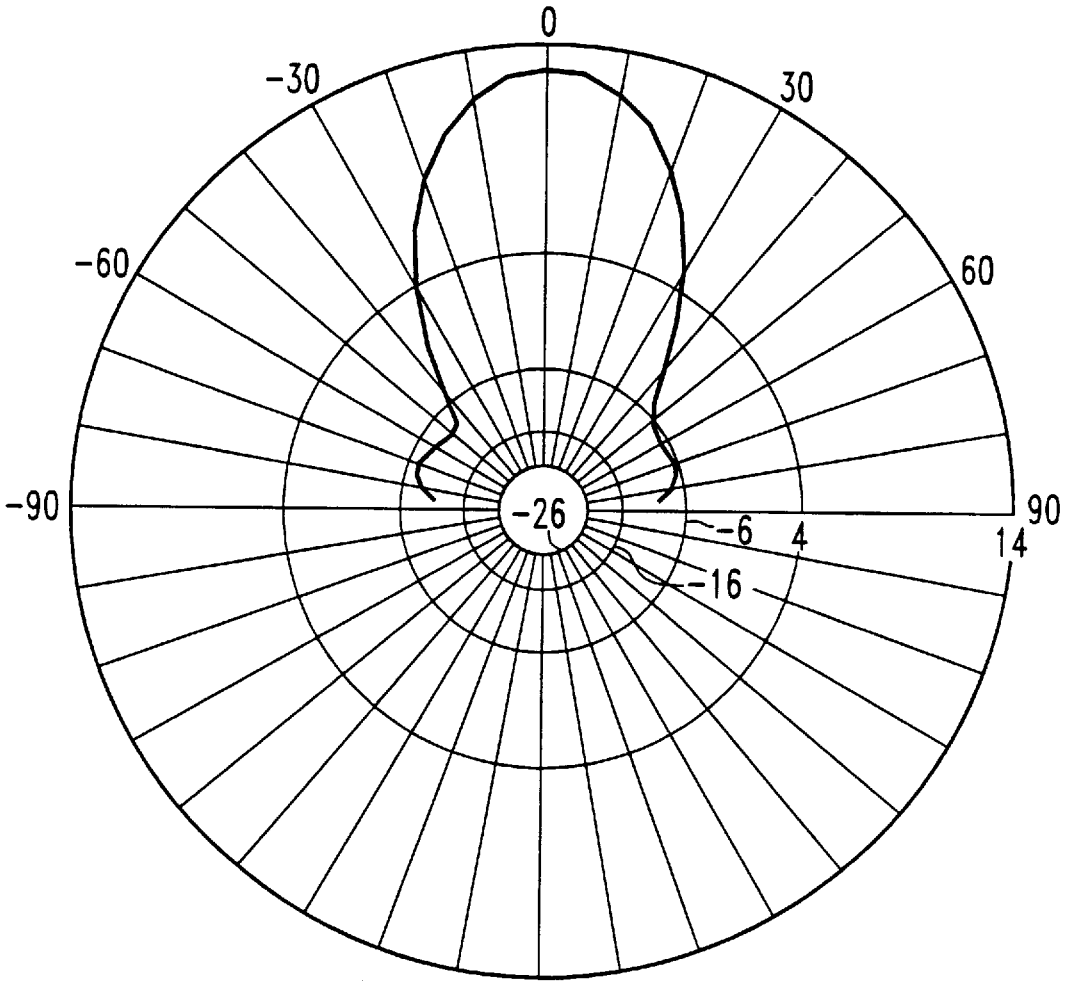
FIG. 10 shows the calculated radiation pattern of a tilted two helical element antenna array wherein each helical element is 1.5 times the length of the helical element whose radiation characteristic is shown in FIG. 9.

FIGS. 9 and 10 show the calculated effects on the gain by increasing the axial length of the helical radiators. FIG. 9 shows the calculated gain of a tilted two helical element array having a unit length. FIG. 10 also shows a tilted two helical element array, but having an axial length which is 1.5 units long.

It is to be understood that the helical radiators disclosed above may be constructed by any known means such as by winding round tubing, flat strips, single conductors, multi filar conductors, etc., into a helical geometry. It is further to be understood that the helix shape may take a wide variety of forms including, but not limited to, a uniform or cylindrical diameter helix, tapered diameter helix, conical diameter helix, or non-uniformed diameter helix.

Although FIGS. 1(*a*), 1(*b*), 5 and 6 show ground planes, it is to be understood that such ground planes are not necessary to the proper operation of this invention and may be omitted. Furthermore, cavity backed helical radiators are also within the contemplation of this invention. Such cavities generally decrease the back radiation and increase the forward gain of the radiator. Depending upon the application, such cavities may be added to the antenna arrays disclosed herein.

Experimental Results

The tilted two helical element antenna array shown in FIGS. 1(*a*) and 1(*b*) was experimentally tested. These tests were conducted in the frequency range of 1520 Mhz to 1660 Mhz. Each helical radiator 150, 160 was approximately 2.5 inches in diameter and 4.3 inches high. The helix geometry was cylindrical. Gain measurements were taken at 1520 Mhz, 1590 Mhz, and 1660 Mhz. Using a radiator spacing of 3.8 inches (approximately ½ wavelength) and an inclination angle θ of approximately 4°, the measured gain at each of the three frequencies was approximately 1 dB higher than a similar design wherein the tilt angle θ was 0°. Thus, by constructing an antenna array according to the above-described principles, approximately 1 dB higher gain was achieved.

The invention being thus described, it will be apparent that the same may be varied in many ways. For example, other shapes, such as rectangles, may be used for the ground plane stubs. Such variations are not to be regarded as a departure from the spirit and scope of the invention, and such modifications as would be obvious to one skilled in the art are intended to be included within the scope of the following claims.

We claim:

1. An antenna, comprising:

a first axial mode helical radiator having a first helix axis;

a second axial mode helical radiator having a second helix axis spaced apart from the first helix axis by a distance substantially equal to half of an operating wavelength of a signal being transmitted or received by said first and second helical radiators;

wherein the first helix axis is not parallel to the second helix axis.

2. The antenna of claim 1, wherein the first helix axis is tilted by an inclination angle with respect to the second helix axis.

3. The antenna of claim 2, wherein the inclination angle is approximately 8 degrees.

4. An antenna for transmitting and receiving a signal of wavelength λ, comprising:

a first axial mode helical radiator having a first helix axis;

a second axial mode helical radiator having a second helix axis spaced apart from the first helix axis by a distance substantially equal to λ/2;

a third axial mode helical radiator having a third helix axis spaced apart from the second helix axis by a distance substantially equal to λ/2;

wherein the first helix axis is not parallel to the second helix axis and wherein the third helix axis is not parallel to the second helix axis.

5. The antenna of claim 4, wherein the first helix axis is tilted by a first inclination angle with respect to the second helix axis.

6. The antenna of claim 5, wherein the first inclination angle is approximately 4 degrees.

7. The antenna of claim 5, wherein the second inclination angle is approximately 4 degrees.

8. The antenna of claim 4, wherein the third helix axis is tilted by a second inclination angle with respect to the second helix axis.

9. A method of efficiently radiating and receiving a signal of wavelength λ along an antenna, comprising the steps of:

delivering the signal to a first axial mode helical radiator having a first helix axis;

delivering the signal to a second axial mode helical radiator having a second helix axis;

spacing the first helix axis at a distance substantially equal to λ/2 from the second helix axis; and tilting the first helix axis relative to the second helix axis such that the first helix axis is not parallel to the second helix axis.

10. The method of claim 9, wherein the tilting step inclines the first helix axis by approximately 8 degrees relative to the second helix axis.

11. A method of efficiently radiating a signal of wavelength λ along an antenna, comprising the steps of:

delivering the signal to a first axial mode helical radiator having a first helix axis;

delivering the signal to a second axial mode helical radiator having a second helix axis delivering the signal to a third axial mode helical radiator having a third helix axis;

spacing the first helix axis at a distance substantially equal to λ/2 from the second helix axis;

spacing the third helix axis at a distance substantially equal to $\lambda/2$ from the second helix axis;

a first tilting step for inclining the first helix axis relative to the second helix axis such that the first helix axis is not parallel to the second helix axis; and a second tilting step for inclining the third helix axis relative to the second helix axis such that the third helix axis is not parallel to the second helix axis.

12. The method of claim 11, wherein the first tilting step inclines the first helix axis by approximately 4 degrees relative to the second helix axis.

13. The method of claim 11, wherein the second tilting step inclines the third helix axis by approximately 4 degrees relative to the second helix axis.

* * * * *